US006360440B1

(12) United States Patent
Perry et al.

(10) Patent No.: US 6,360,440 B1
(45) Date of Patent: Mar. 26, 2002

(54) METHOD FOR LOCATING INJECTOR BALL VALVE GUIDE

(75) Inventors: Robert B. Perry, Leicester; Karl Jacob Haltiner, Jr., Fairport; Michael Schneider, Rochester, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/661,230

(22) Filed: Sep. 13, 2000

(51) Int. Cl.[7] ..... B21D 51/16; F05B 1/30

(52) U.S. Cl. ..... 29/890.13; 239/585.4; 239/600; 29/468; 29/508; 29/890.124

(58) Field of Search ..... 29/890.124, 890.122, 29/890.126, 890.13, 890.132, 888.41, 464, 468, 469, 505, 506, 508; 239/585.1, 585.4, 585.5, 600

(56) References Cited

U.S. PATENT DOCUMENTS 5,042,151 A * 8/1991 Roush ..... 29/890.124
5,209,408 A * 5/1993 Reiter ..... 239/585.4
5,494,224 A * 2/1996 Hall et al. ..... 239/585.5
5,517,190 A * 5/1996 Gunn ..... 340/870.18
5,625,946 A * 5/1997 Wildeson et al. ..... 29/888.41
5,704,553 A * 1/1998 Wieczorek et al. ..... 239/585.1
6,047,907 A * 4/2000 Hornby ..... 239/585.1
6,189,816 B1 * 2/2001 Stier ..... 29/890.132

* cited by examiner

*Primary Examiner*—S. Thomas Hughes
*Assistant Examiner*—Marc Jiminez
(74) *Attorney, Agent, or Firm*—John Vanophem

(57) ABSTRACT

A method for locating an injector ball valve guide in alignment with a valve seat mounted in a common recess of an injector valve body. The valve guide is a disk that has a central opening which guides a valve ball of an associated valve member. During assembly, the guide disk is aligned with the valve seat by a locating tool having an oversized ball on a load rod. The oversized ball is fitted closely within the central opening of the guide and is seated on the ball seat to align the seat and opening. The valve seat and guide disk are then locked in the recess by crimping edges of the recess against the valve seat. The locating tool is removed and assembly of the remaining injector components is completed. The method simplifies alignment of the seat and guide components. In a variation of the method, the guide is aligned with and fixed to the valve seat with the oversized ball in place to form an aligned subassembly for subsequent installation into a fuel injector.

1 Claim, 4 Drawing Sheets

METHOD FOR LOCATING INJECTOR BALL VALVE GUIDE

TECHNICAL FIELD

This invention relates to engine fuel injectors and, more particularly, to a method for locating an injector ball valve guide during or prior to crimping of the valve seat and guide in a valve body.

BACKGROUND OF THE INVENTION

It is known in the art relating to solenoid actuated engine fuel injectors to provide an armature fixed to a valve ball to act as a solenoid actuated valve element. The valve ball is seatable on a valve seat and guided by a disk guide, the guide and valve seat being mounted in a recess of a valve body and secured therein by crimping an edge of the recess. The guide is provided to maintain the valve ball in close alignment with the valve seat when the valve is open so that uniform fuel flow around the valve will be promoted and closure of the valve will require a minimum of sliding motion on the seat with a minimum of closing time. Typically, aligning the valve guide with the valve seat during assembly and crimping has involved excessively costly and complicated alignment methods.

SUMMARY OF THE INVENTION

The present invention provides a method for assembly of a valve guide disk and a valve seat in an injector valve body, wherein the guide disk has a guide opening for guiding a valve ball with slight clearance and the valve seat has a ball seat facing the guide disk in assembly for engagement by the valve ball in a valve closed position. An exemplary form of the method includes:

- providing a valve body having a through passage with inlet and outlet ends and an enlarged recess at the outlet end for receiving a valve guide disk and a valve seat, the recess having a crimpable edge;
- inserting a locating tool from the inlet end into the through passage of the valve body, the locating tool having an oversize locating ball receivable within the guide opening with minimal clearance;
- inserting a guide disk and a valve seat into the recess with the guide opening engaging the locating ball, the guide disk engaging an end surface of the recess and the valve seat engaging a flat surface of the guide disk;
- seating the locating ball on the valve seat, thereby aligning the guide opening of the guide disk with the ball seat of the valve seat;
- loading the valve seat and guide disk against the end surface of the ecess;
- concurrently crimping the edge of the recess against the valve seat to maintain the valve seat and guide disk in their aligned positions in the recess; and
- removing the locating tool from the guide opening for assembly of the resulting valve body assembly into a fuel injector.

In a variation of the above method, the guide disk and valve seat are aligned by the oversized ball and then tack welded or otherwise fixed together. The result is an aligned subassembly for subsequent installation into a fuel injector by conventional assembly processes.

These and other features and advantages of the invention will be more fully understood from the following description of certain specific embodiments of the invention taken together with the accompanying drawings.

DESCRIPTION OF THE PREFERRED EMBODIMENT

Figure 1:
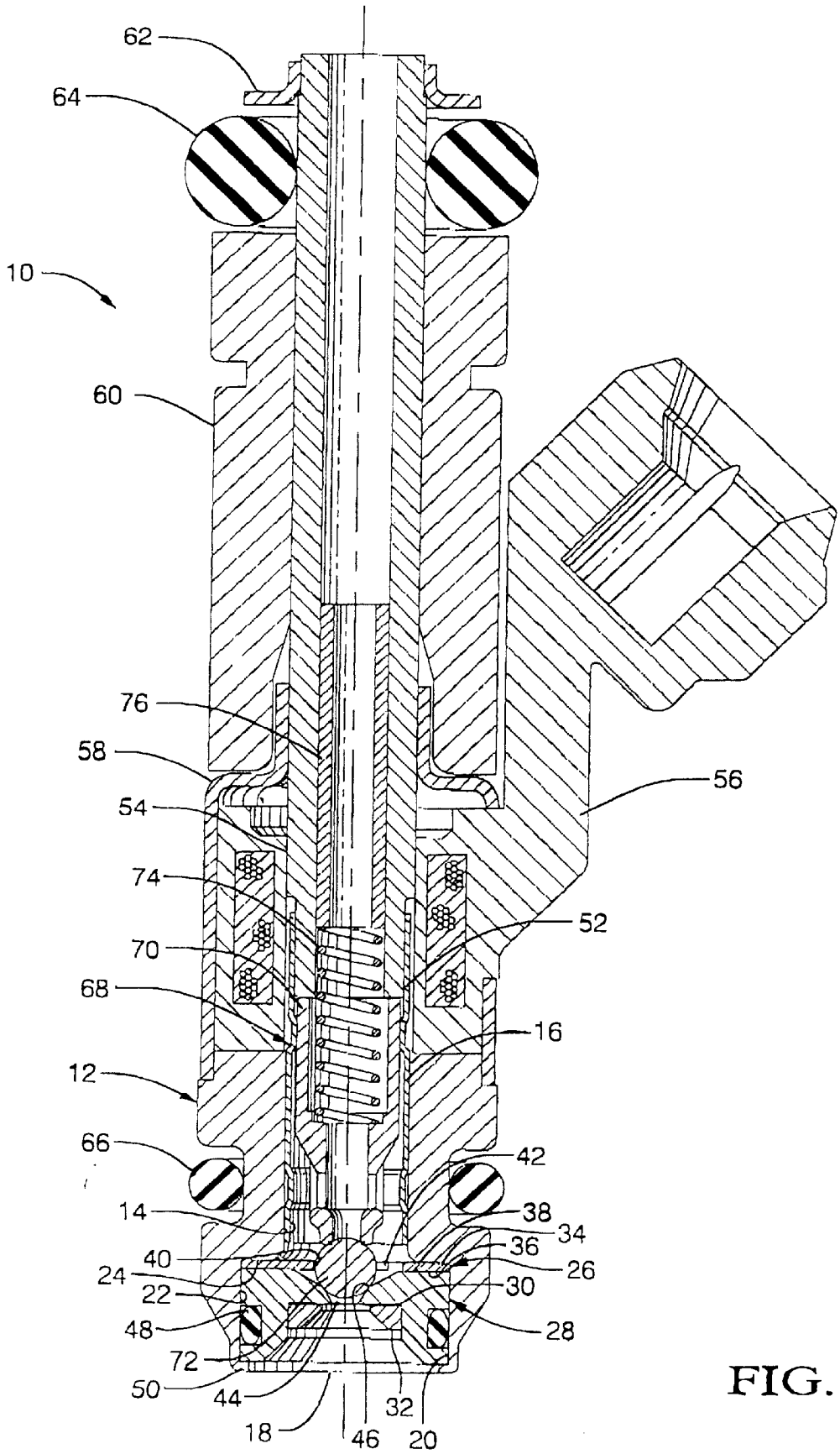
FIG. 1 is a cross-sectional view of an engine fuel injector assembled in part by the method of the present invention.

Referring now to the drawings in detail, numeral 10 generally indicates a solenoid actuated plunger type ball valve fuel injector capable of being partially assembled by the method of the present invention. Injector 10 includes a valve body 12 having a through passage 14 with inlet 16 and outlet 18 ends. The outlet end 18 includes an enlarged counterbore shaped recess 20 having a cylindrical inner surface 22 and a flat annular end surface 24.

Within the recess 20, there are received a guide disk 26 and a valve seat 28 which also carries a distributor plate 30 and a retainer 32. The guide disk 26 is loosely received within the cylindrical surface 22 of the valve body 12 and has flat upper and lower sides 34, 36 respectively engaging the end surface 24 and a flat upper surface 38 of the valve seat 28. A central guide opening 40 is provided in the guide disk surrounded by several fuel conducting openings 42 spaced around the guide opening.

The valve seat 28 has a central passage 44 surrounded on an upper side by a circular ball seat 46 of any suitable shape, such as conical or curved sided. Below the passage 44, the director plate 30 is held in a lower recess by the retainer 32. A seal ring 48 prevents fuel leakage around the valve seat 28 which is retained in the recess 20 by a crimped lower edge 50 at the outlet end 18 of the valve body 12.

A tubular upper guide 52 is brazed in the inlet end 16 of the valve body passage 14 and extends upward to a sealing connection with a fuel tube 54, which also acts as a magnetic pole and valve stop. A coil assembly 56 is mounted around the fuel tube and upper guide and is held in place by an outer strap 58 welded at opposite ends to the fuel tube 54 and the valve body 12. A spacer 60 is positioned above the strap 58 and cooperates with an end ring 62 to retain a seal ring 64. A groove around the valve body also retains a lower seal ring 66.

A reciprocable valve member 68 is located within the passage 14 of the valve body 12. Member 68 includes a hollow armature 70 guided by the upper guide 52 and carrying at its lower end a valve ball 72 that extends into and is guided by the guide opening 40 of the guide disk 26. A spring 74 in the armature 70 is compressed by a calibration tube 76 pressed into the fuel tube 54 to provide a set biasing force urging the valve ball 72 against the ball seat 46. A small gap between the valve armature 70 and the lower end of the fuel tube (magnetic pole) 54 allows the valve to be opened a set amount when the coil is energized, drawing the valve member 68 upward, against the valve stop (tube 54).

The guide opening 40 in the guide disk 26 centers the valve ball 72 when the valve is open and guides the ball to its seat 46 when the valve is closed. Thus, it is important that the central opening 40 of the disk 26 be aligned with the ball seat 46 of the valve seat 28. The present invention provides a method of assembling the components within the valve body 12 which assures that alignment is accomplished and maintained in operation.

Figure 2:
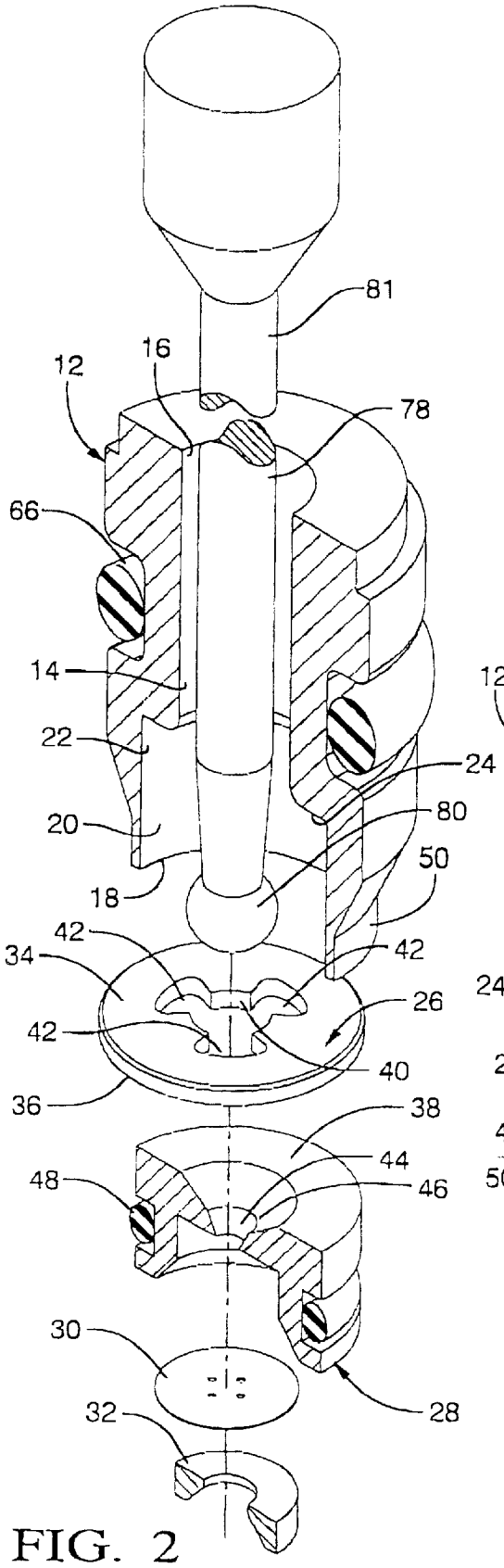
FIG. 2 is an exploded pictorial view showing components of the valve body assembly with an oversize ball alignment tool.

FIG. 2 shows the relations of the assembled components retained in the valve body 12 together with a locating tool 78 for centering the guide disk 26. Tool 78 includes an oversized ball 80 mounted on the end of a loading rod 81. The ball 80 is sized to fit closely with minimal clearance within central opening 40 of the guide disk 26. The crimpable lower edge 50 at the outlet end 18 of the valve body 12 is not yet crimped, allowing insertion of the guide disk 26 and valve seat 28 into the recess 20 of the body 12. The distributor plate 30 and retainer 32 may have been previously installed in the valve seat or they can be inserted later as desired.

Figure 3:
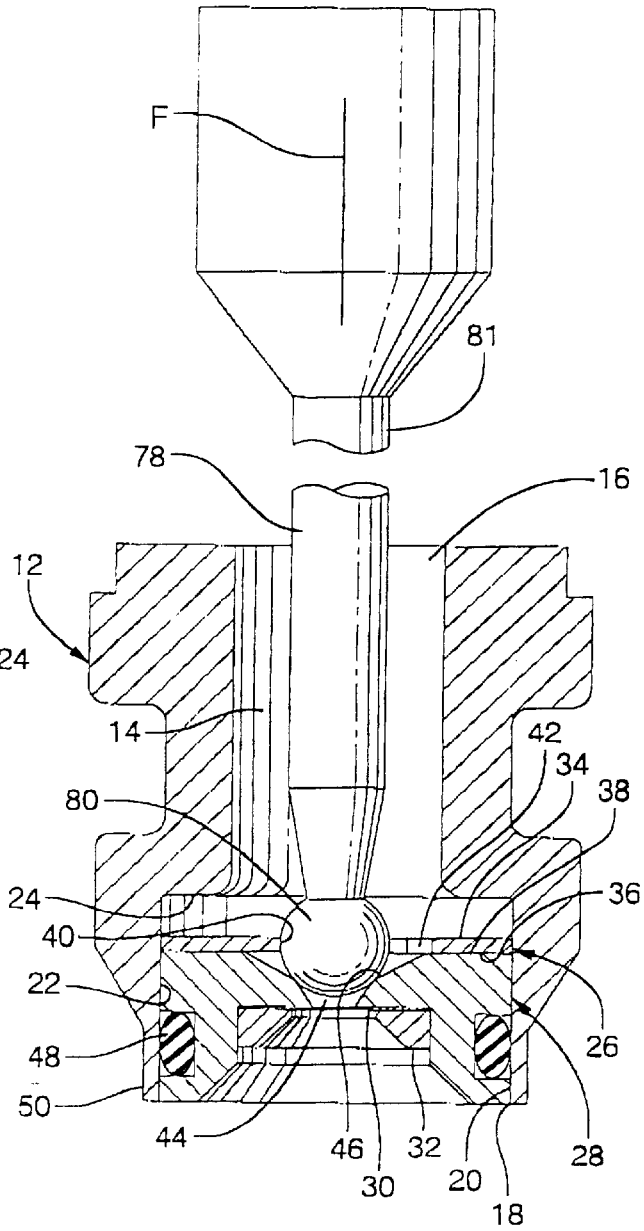
FIG. 3 is a cross-sectional view showing alignment of the valve guide and seat by the alignment tool.

To begin the assembly method of the invention, the locating tool is inserted into the through passage 14 of the valve body with the oversized ball 80 positioned adjacent the flat end surface 24 of the recess 20. The guide disk 26 and the valve seat 28 are then inserted into the recess 20 with the guide disk engaging the flat end surface 24 of the recess and the valve seat engaging the lower side 36 of the guide disk 26. The ball 80 of the locating tool 78 is then located within the central guide opening 40 of the guide disk and the ball 80 is seated against the ball seat 46, thereby axially aligning the guide opening 40 with the ball seat 46, as shown in FIG. 3 of the drawings.

Figure 4:
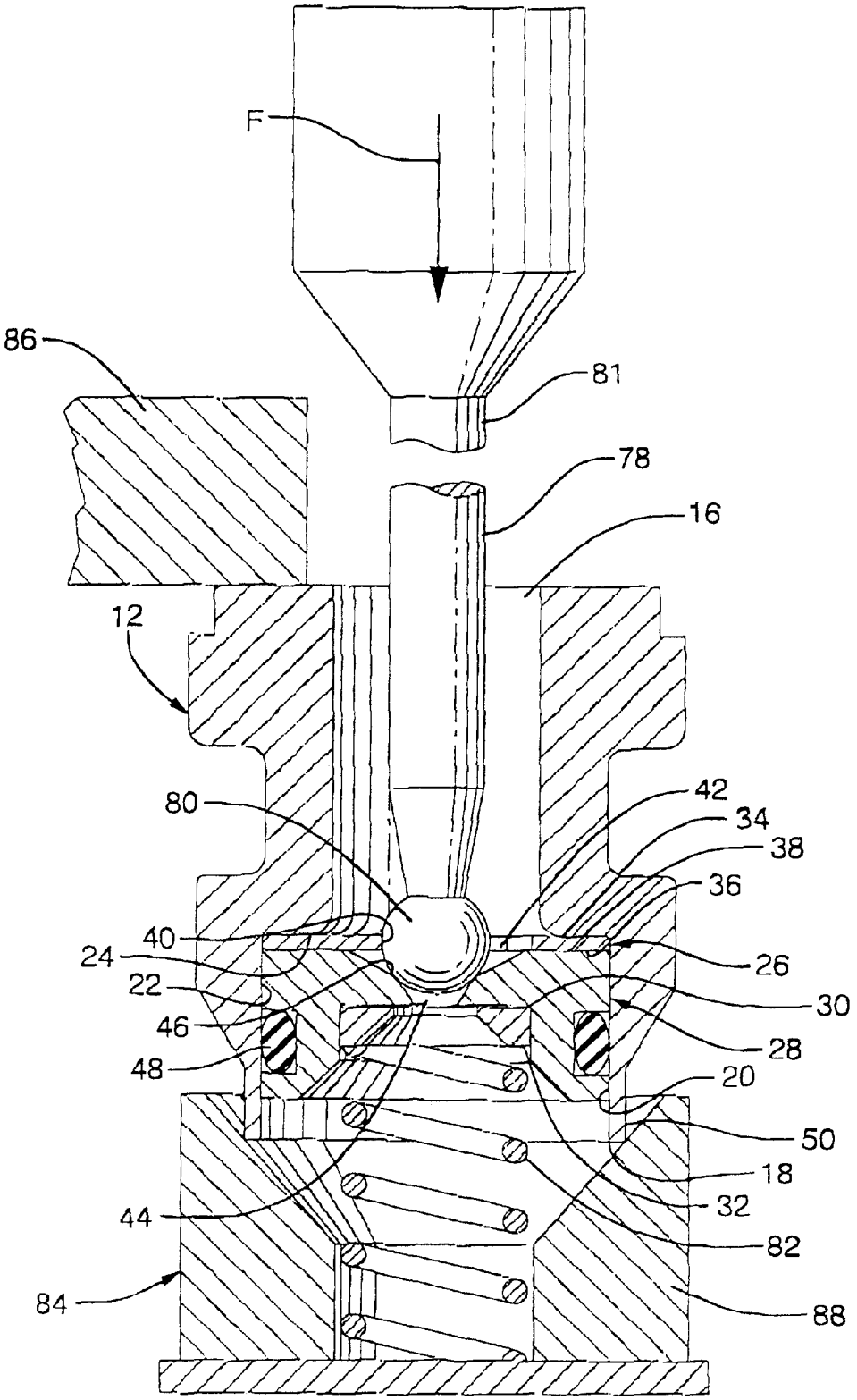
FIG. 4 is a cross-sectional view showing loading and crimping of the seat and guide in the valve body.

As shown in FIG. 4, the valve seat 28 and guide disk 26 are than held in their aligned positions against the end surface 24 of the body recess 20 by means such as a biasing spring 82 of a crimping fixture 84. A backup member 86 is positioned against the upper end of the valve body 12 and a crimping tool 88 is advanced against the lower edge 50 of the body 12. The tool 88 deforms the lower edge 50 inward, against the outer edge of the valve seat 28, locking the valve seat and disk 26 in the recess 20 with the disk opening 40 and ball seat 46 in alignment. The valve body assembly is then removed from the crimping fixture and the locating tool is removed from the passage 14. The assembly may then be assembled together with the remaining components of the injector as shown in FIG. 1.

Figure 5:
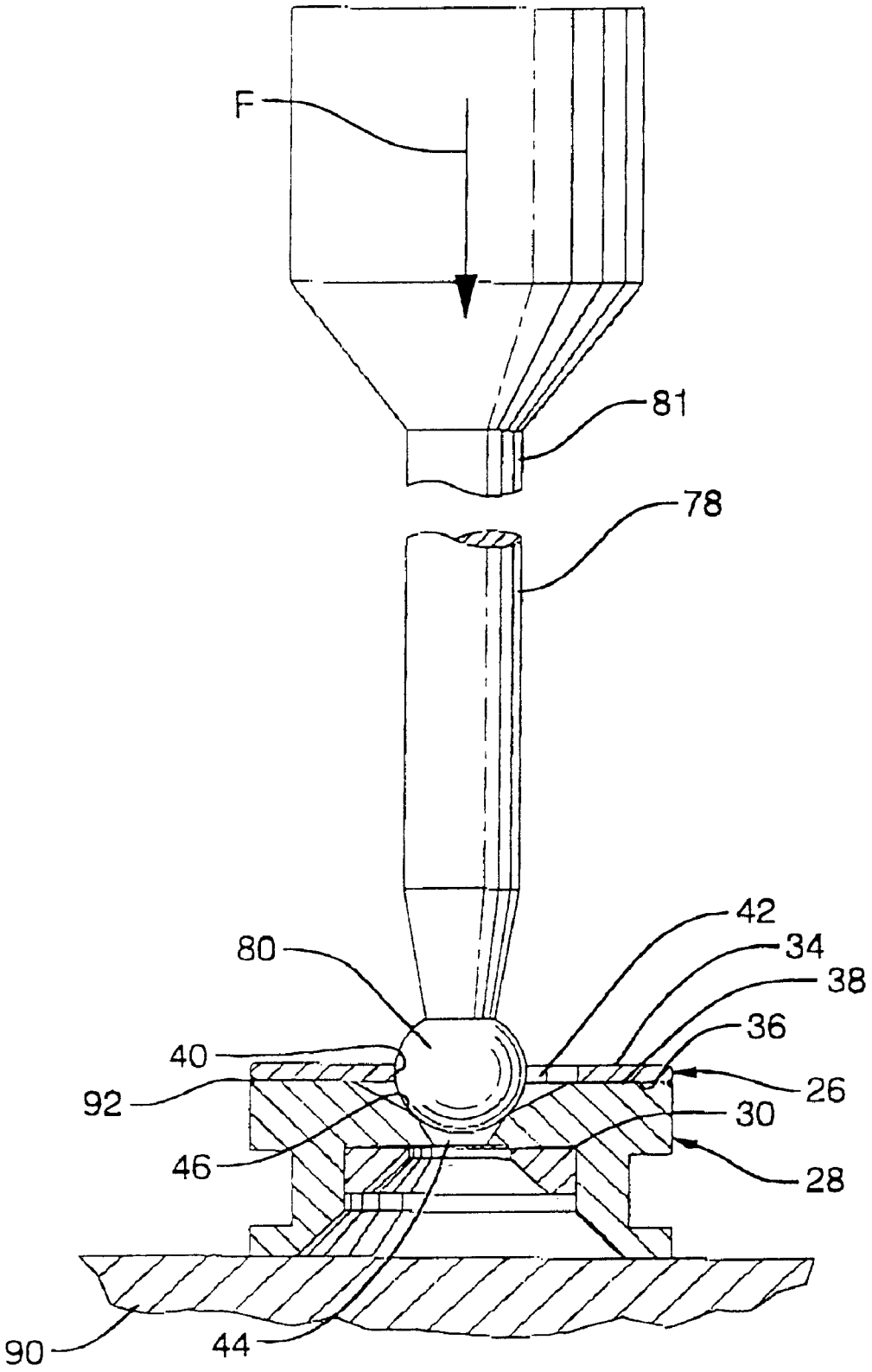
FIG. 5 is a cross-sectional view showing forming of a subassembly by aligning and fixing the seat and guide prior to assembly into an injector.

FIG. 5 shows a key step in a modified version of the invention. As shown, the valve seat 28 is placed on a holding fixture 90 with the guide disk 26 disposed on the upper surface of the seat. The oversized ball 80 is then inserted into the central guide opening 40 engaging the ball seat 46, thereby aligning the disk opening with the ball seat. With the ball 80 in place, the disk 26 is then tack welded, as at 92, or otherwise fixed to the valve seat 28, forming a subassembly 26–28 wherein the guide and seat are prealigned. The subassembly 26–28 is then assembled into the injector body and the injector assembly is completed by conventional assembly steps.

While the invention has been described by reference to certain preferred embodiments, it should be understood that numerous changes could be made within the spirit and scope of the inventive concepts described.

Accordingly, it is intended that the invention not be limited to the disclosed embodiments, but that it have the full scope permitted by the language of the following claims.

What is claimed is:

1. A method for assembly of a valve guide disk and a valve seat in an injector valve body, the guide disk having a guide opening for guiding a valve ball with slight clearance, and the valve seat having a ball seat facing the guide disk in assembly for engagement by the valve ball in a valve closed position, said method comprising:

providing a valve body having a through passage with inlet and outlet ends and an enlarged recess at the outlet end for receiving the valve guide disk and the valve seat, the recess having a crimpable edge;

inserting a locating tool from the inlet end into the through passage of the valve body, the locating tool having an oversize locating ball receivable within the guide opening with minimal clearance;

inserting the guide disk and the valve seat into the recess with the guide opening engaging the locating ball, the guide disk engaging an end surface of the recess and the valve seat engaging a flat surface of the guide disk;

seating the locating ball on the ball seat, thereby aligning the guide opening of the guide disk with the ball seat of the valve seat;

loading the valve seat and the guide disk against the end surface of the recess with a biasing spring of a crimping fixture, the biasing spring biasing the valve seat and the guide disk against the end surface of the recess;

concurrently crimping the edge of the recess against the valve seat to maintain the valve seat and guide disk in their aligned positions in the recess; and removing the locating tool from the guide opening for assembly of the resulting valve body assembly into a fuel injector.

* * * * *